United States Patent [19]

McDougal

[11] Patent Number: 4,514,712

[45] Date of Patent: Apr. 30, 1985

[54] IGNITION COIL

[76] Inventor: John A. McDougal, 2314 E. Court St., Flint, Mich. 48503

[21] Appl. No.: 894,449

[22] Filed: Apr. 7, 1978

Related U.S. Application Data

[63] Continuation of Ser. No. 549,717, Feb. 13, 1975, abandoned, and a continuation-in-part of Ser. No. 384,469, Aug. 1, 1973, abandoned.

[51] Int. Cl.[3] ..... H01F 27/04; H01F 27/30

[52] U.S. Cl. ..... 336/96; 174/35 SM; 174/77 S; 123/169 PA; 123/634; 336/105; 336/107; 336/198; 339/26

[58] Field of Search ..... 336/105, 192, 107, 96, 336/198, 208, 209, 180; 174/35 SM, 77 S; 339/117 R, 26, 143 S, 94 R; 123/148 A, 148 D, 169 R, 169 P, 169 PA, 169 PH; 313/131 R; 200/51.1

[56] References Cited

U.S. PATENT DOCUMENTS

| | | | |
|---|---|---|---|
| 995,400 | 6/1911 | Cavanagh | 123/148 A |
| 1,011,884 | 12/1911 | Cavanagh | 123/148 A |
| 1,106,525 | 8/1914 | Thomson et al. | 123/148 A |
| 1,326,366 | 12/1919 | Milton | 339/26 |
| 1,393,866 | 10/1921 | Whisler | 123/148 A |
| 1,395,375 | 11/1921 | Whisler | 123/148 A |
| 1,568,584 | 1/1926 | Blankenship | 200/51.1 |
| 2,056,739 | 10/1936 | Rabezzane | 339/143 S |
| 2,419,683 | 4/1949 | Henschke | 339/97 R |
| 2,463,924 | 3/1949 | Van Orden | 174/35 SM |
| 2,470,821 | 5/1949 | Humrichouse et al. | 313/131 R |
| 2,478,087 | 8/1949 | Bychinsky et al. | 123/148 A |
| 2,648,030 | 8/1953 | Kiekhaefer | 339/26 X |
| 2,724,092 | 11/1955 | Simpkins et al. | 339/26 |
| 3,076,113 | 1/1963 | Candelise | 174/77 S |
| 3,128,139 | 4/1964 | Estes | 339/143 S X |
| 3,311,783 | 4/1964 | Gibbs et al. | 315/226 |
| 3,321,733 | 5/1967 | Thomas | 339/94 R |
| 3,686,607 | 8/1972 | Berry | 174/35 SM |
| 3,803,529 | 4/1974 | Rohrig et al. | 339/143 S X |

*Primary Examiner*—Thomas J. Kozma

*Attorney, Agent, or Firm*—Harness, Dickey & Pierce

[57] ABSTRACT

An ignition coil for spark ignited internal combustion engines intended for mounting on and connection to a spark plug which simplifies high voltage distribution, promotes maintenance and safety, lessens radio interference, and reduces exhaust emissions. The ignition coil preferably has a tight fitting resilient insulating boot engaging the spark plug. The boot member preferably has an air passage with a contaminate filter for facilitating the insertion of the boot on the spark plug. One embodiment includes a grounding member connected to the ground lead of the primary winding of the ignition coil which engages either the grounded portion of the spark plug or the cylinder head for grounding the primary winding of ignition coil.

33 Claims, 18 Drawing Figures

To Remaining Ignition Coil Circuits
To Timing CKT. Means
Capacitor Discharge section
18
16g
16
14
12p
12s
12
30b
34
32
24
20
58a
22
12p'
12s
60a
24a
46
12p"
53
38
54
40
3
2
50
62
24b
30
57
12s'
48
24e
58
56
42
44
60
24c
28w
28
14p
26
30a
14i
14
14q
4
24a
28w
50
28w
28
14
60
73
12p"
34
32
24c
53
22
73
60
14
14q

IGNITION COIL

CROSS REFERENCE TO RELATED APPLICATIONS

This application is a continuation of Application Ser. No. 549,717, filed Feb. 13, 1975, abandoned, and is a continuation-in-part of application Ser. No. 384,469, filed Aug. 1, 1973, abandoned.

BACKGROUND AND SUMMARY OF THE INVENTION

The present invention relates to ignition systems for internal combustion engines and in particular to novel ignition coil structure which eliminates high voltage distribution in the system, promotes easier maintenance and improved safety and reliability, minimizes radio interference and reduces exhaust emissions especially in older vehicles.

The secondary, or high voltage, portions of engine spark ignition systems have experienced little fundamental change since the days of Charles Kettering. Although advances in semiconductor technology have recently been widely applied to improve performance and reduce maintenance of the primary, or low voltage, portions of ignition systems, the highly vulnerable rotor, distributor cap, and high voltage harness remain in widespread use on multicylinder production gasoline automobile engines.

While these high voltage distribution systems may be made to function satisfactorily when new, such is typically not the case as the automobile becomes older. In the high temperature environment under the automobile hood, organic rubber parts rapidly age and crack. Moisture and salt spray together with under hood dirt provide conductive flashover and leakage paths resulting in missing, crossfiring, and difficult starting. The multiple conductors of the high voltage harness provide excellent antennae for conducting and radiating radio frequency noise produced by the ignition system. The commutating spark between the distributor rotor and terminals of the distributor cap has been identified in reliable scientific studies as the primary source of ignition in under hood fires which may follow accidents or other gasoline leakage under the hood. The interior of the distributor cap requires ventilation to the atmosphere to prevent pressure build up and corrosion; while some distributors have been produced which are vented through a Davey Screen, these are not in widespread use.

The present invention is directed to a novel ignition system which substantially alleviates, or eliminates entirely, the aforementioned and other problems associated with currently prevailing ignition systems which use a mechanical distributor and a high voltage harness for supplying energy to the spark plug. The advantages resulting from the present invention include: a substantial reduction of ignition maintenance cost; a substantial reduction of radio interference; improved reliability of ignition; and reduction of automobile exhaust hydrocarbon and carbon monoxide emissions particularly in automobiles in advanced age and use. Furthermore, the present invention can render feasible marine ignition systems capable of operation for significant periods of time while covered with sea water as well as ignition systems capable of operation in combustible atmospheres without danger of fire or explosion. Novel aspects of the disclosure include novel ignition coil structure, novel ignition structure, a novel method for making an ignition coil, a novel means for grounding the primary winding of the ignition coil, and a novel means for assuring a tight fit between the insulating member which surrounds the ignition coil and the spark plug which includes a filtered vent passage for allowing egress of air trapped between the insulating member and the spark plug.

Additional advantages and features of the invention, along with those already mentioned, will be seen in the ensuing description and claims which are to be taken in conjunction with the accompanying drawings.

BRIEF DESCRIPTION OF THE DRAWINGS

The drawings illustrate a preferred embodiment of the present invention in accordance with the best mode presently contemplated for carrying out the invention.

FIG. 2 is a view taken in the direction of arrow 2 in FIG. 1;

FIG. 3 is a view taken in direction of arrow 3 of FIG. 1;

FIG. 4 is a view taken substantially in circle 4 of FIG. 1 illustrating a modified form;

FIG. 18 is a view of a modification of the second embodiment of FIG. 11.

DESCRIPTION OF THE PREFERRED EMBODIMENT

Figure 1:
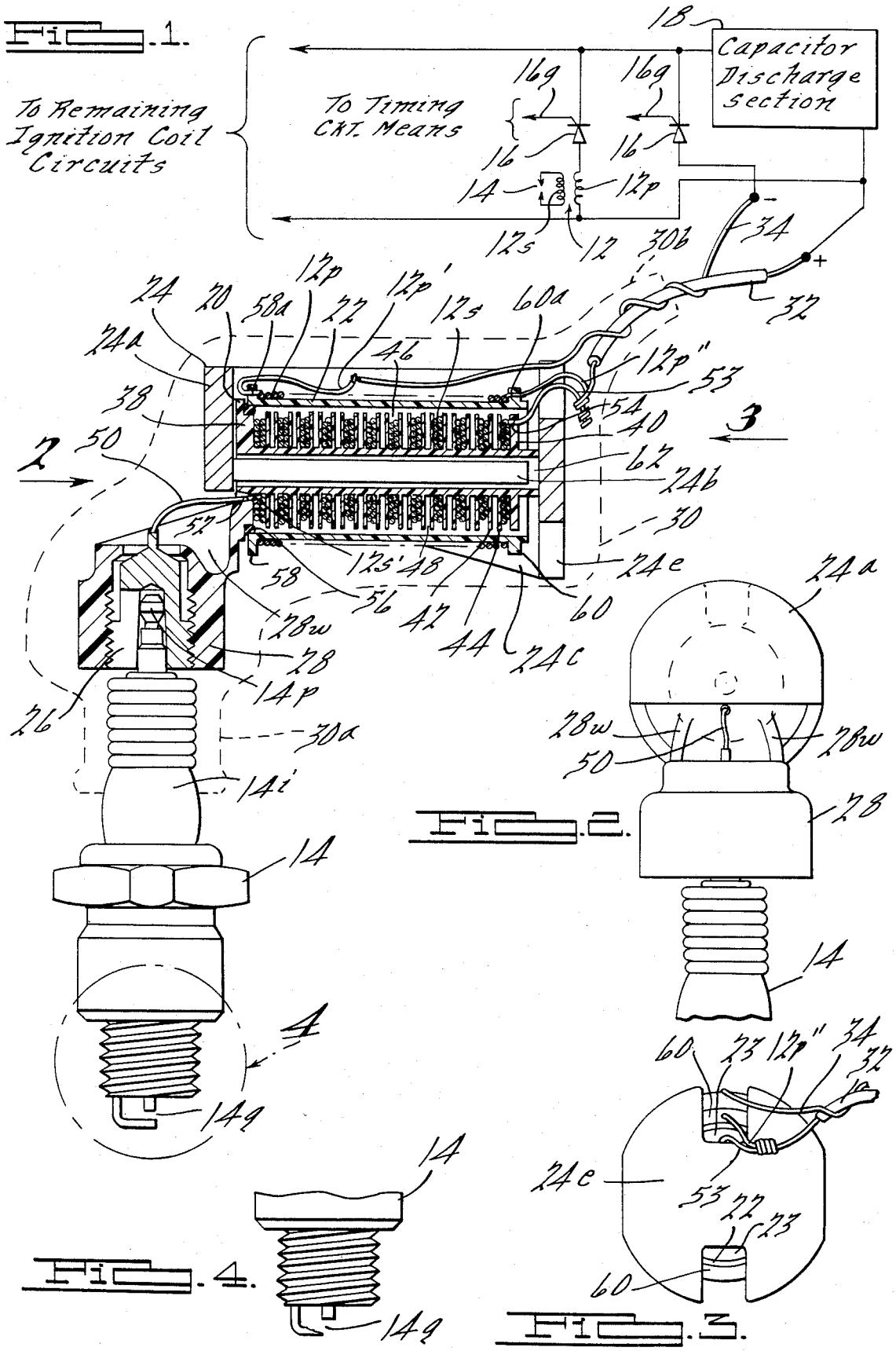
FIG. 1 is a view of a first embodiment illustrating the principles of the present invention; a portion of the view being a longitudinal sectional view through the first embodiment of ignition coil according to the present invention mounted on a spark plug, and the remainder schematically portraying the ignition system.

FIG. 1 illustrates an ignition system for a multi-cylinder internal combustion engine in accordance with the principles of the present invention. For each respective cylinder of the engine there is provided an individual ignition coil 12 which is mounted on and operatively coupled with the spark plug 14 associated with the respective cylinder. The ignition coils 12 are operatively coupled with a low voltage distribution system which sequentially energizes each ignition coil in accordance with the engine operating cycle to produce properly timed firing of each spark plug. The drawing illustrates a low voltage distribution system of the type disclosed in the aforementioned cross referenced patent application of myself and John Lennington, and details of that disclosure are incorporated herein by reference. Briefly, the primary winding 12*p* of each ignition coil 12 is operatively coupled through an electronic switch 16 to a capacitor discharge section 18. The capacitor discharge section 18 includes a capacitor which is arranged to be charged from a source of voltage which may include for example the battery of the vehicle as stepped up from 12 volts to 400 volts by an "inverter" which may include an oscillator to convert DC battery voltage to AC, a step-up transformer, and a rectifier for the higher level voltage. After the capacitor is so charged, the appropriate electronic switch 16 is actuated from a timing circuit means to cause the capacitor to discharge into the primary winding 12*p* of the ignition coil 12 with which the actuated switch is associated. The ignition coil then fires the spark plug to which it is connected thereby igniting the air/fuel mixture in the chamber in which the plug is inserted. The timing circuit means provides properly timed sequencing of the respective switches 16 and in this way the individual coils 12 are sequentially energized in accordance with the engine operating cycle to thereby provide suitably timed spark ignition of the spark plugs 14. Although the timing circuit means is analogous to the distributor currently used on virtually all manufactured multi-cylinder engines, it will be noted that in the present distribution system the timing circuit means voltages and the capacitor discharge section voltage are of sufficiently low magnitudes to be handled by electronic switch means in comparison to the mechanical switching necessary for the high voltages associated with currently used distributor type ignitions. For this reason, the present invention provides a substantial improvement over currently prevailing systems, and this aspect will be developed in subsequent descriptions.

FIGS. 1–3 and 5–10 disclose details of a first embodiment of an ignition coil 12 according to the present invention. Ignition coil 12 comprises a novel plastic bobbin 20 (shown by itself in FIG. 5); a secondary winding 12*s* wound on bobbin 20 in novel fashion as will be seen herein; an outer plastic sleeve 22 which fits over bobbin 20 and secondary winding 12*s* (and shown by itself in FIG. 6); a primary winding 12*p* wound around sleeve 22; an encapsulating material 23 encapsulating and impregnating the secondary winding 12*s* on bobbin 20 within sleeve 22 (and which has been omitted from all drawing figures, save FIG. 3, for sake of clarity); magnetic circuit structure 24 comprising individual elements 24*a*, 24*b*, 24*c*, 24*d* and 24*e* (shown separately in FIG. 10); a brass spark plug terminal connector 26 threaded into the bore of a circular boss 28 fashioned integrally with bobbin 20 and connected with the bobbin via reinforcing webs 28*w* at the left hand end thereof as viewed in FIG. 1; and an encapsulating boot 30 preferably of a hydrophobic material such as silicone rubber enclosing the entire assembly (shown in phantom in FIG. 1 for sake of clarity). As can be seen in FIG. 1, the entire ignition coil 12 is mounted directly on spark plug 14 by pushing connector 26 onto the terminal plug 14*p* of spark plug 14. An important feature of the invention provided by boot 30 resides in the entire enclosure of the secondary voltage system. As can be seen in FIG. 1, boot 30 is provided with a sealing lip 30*a* which seals around the ceramic insulation 14*i* of plug 14 with the coil 12 mounted on the plug 14. Lip 30*a* provides a snug force fit to seal off the connection between connector 26 and terminal plug 14*p*. Furthermore, the opposite end of boot 30 is shaped to provide a seal 30*b* around lead wires 32 and 34 which connect the ignition coil to the primary voltage distribution system. In this way, the entire coil assembly is enclosed to provide both a moisture seal and electrical insulation preventing flashover.

Figure 5:
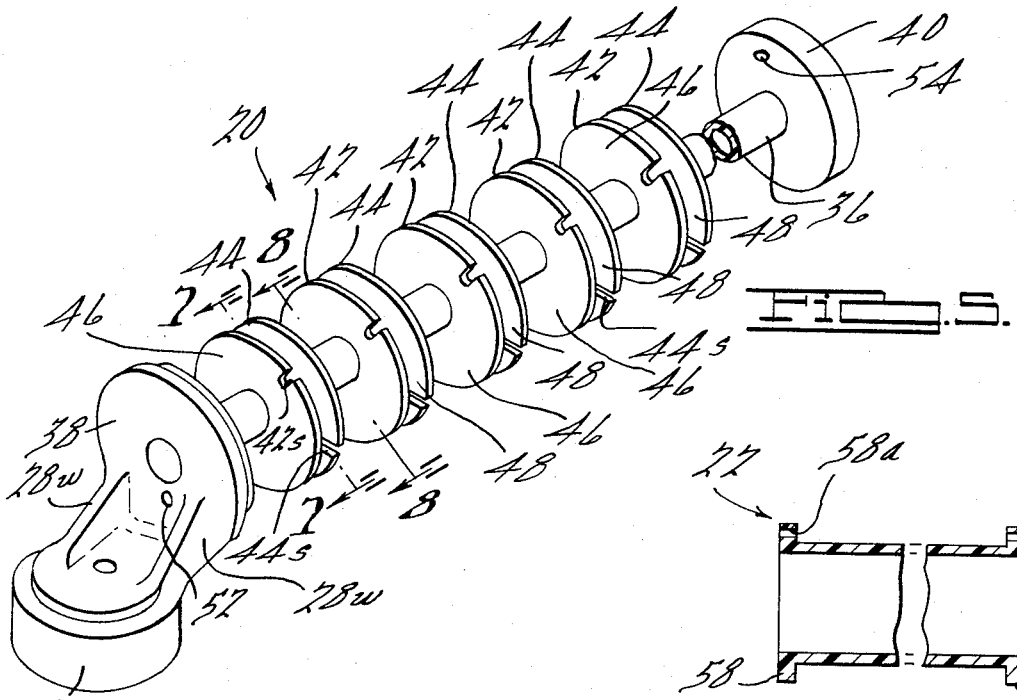
FIG. 5 is an enlarged perspective view of one element of FIG. 1 shown by itself.
Figure 6:
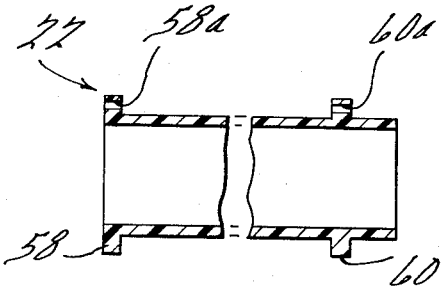
FIG. 6 is a longitudinal sectional view illustrating another element of FIG. 1 shown by itself.

As best seen in FIG. 5 bobbin 20 further comprises a central tubular core 36 open at both ends and a plurality of annular walls, or disc-like partitions, spaced axially along core 36. The end annular walls designated respectively 38 and 40 are of the largest thickness while the walls intermediate end walls 38 and 40 are of lesser, but uniform, thickness. Core 36 forms a cylindrical root surface between adjacent walls and of uniform diameter throughout the length of bobbin 20 between end walls 38 and 40. The intermediate walls are arranged in pairs with one wall of each pair (the nearer wall as viewed in FIG. 5) being identified by the numeral 42 and the other by the numeral 44. Each wall 42 has a shallow radial slot 42*s* extending radially inwardly from the outer periphery thereof. The slots 42*s* are relatively narrow and all are axially aligned. Each wall 44 has a similarly narrow but much deeper slot 44*s* extending radially inwardly to core 36. The slots 44*s* are axially aligned with each other but are circumferentially offset relative to the slots 42*s*. It will also be observed that walls 42 and 44 are arranged in a uniform pattern along bobbin 20 such that a plurality of identical annularly shaped coil receiving spaces 46 are provided on bobbin 20. The coil receiving spaces 46 are separated by narrower annular separating spaces 48. As will be explained presently, a coil section of secondary winding 12*s* is contained in each of the coil receiving spaces 46, and therefore, each pair of walls 42, 44 and the intermediate separating space 48 provide a separating structure between immediately adjacent coil sections of the secondary winding. Stated differently the wall 42 of one pair of walls 42, 44 and the immediately adjacent wall 44 of the immediately adjacent pair 42, 44 define a coil receiving space 46, and the spaces 46 are axially separated by the separating spaces 48. (The nearest coil receiving space 46 is, of course, defined by end wall 38 and the immediately adjacent wall 42, while the furthest coil receiving space 46 is defined by end wall 40 and the immediately adjacent wall 44.)

Figures 7, 8, 9:
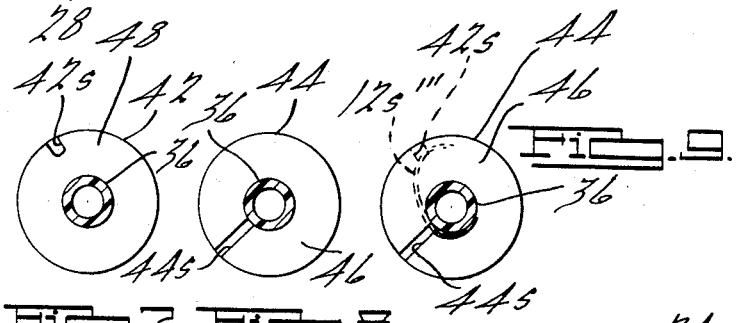
FIG. 7 is a view taken along line 7—7 in FIG. 5.
FIG. 8 is a view taken along line 8—8 in FIG. 5.
FIG. 9 is a view similar to FIGS. 7 and 8 illustrating further details of FIG. 1.
Figure 10:
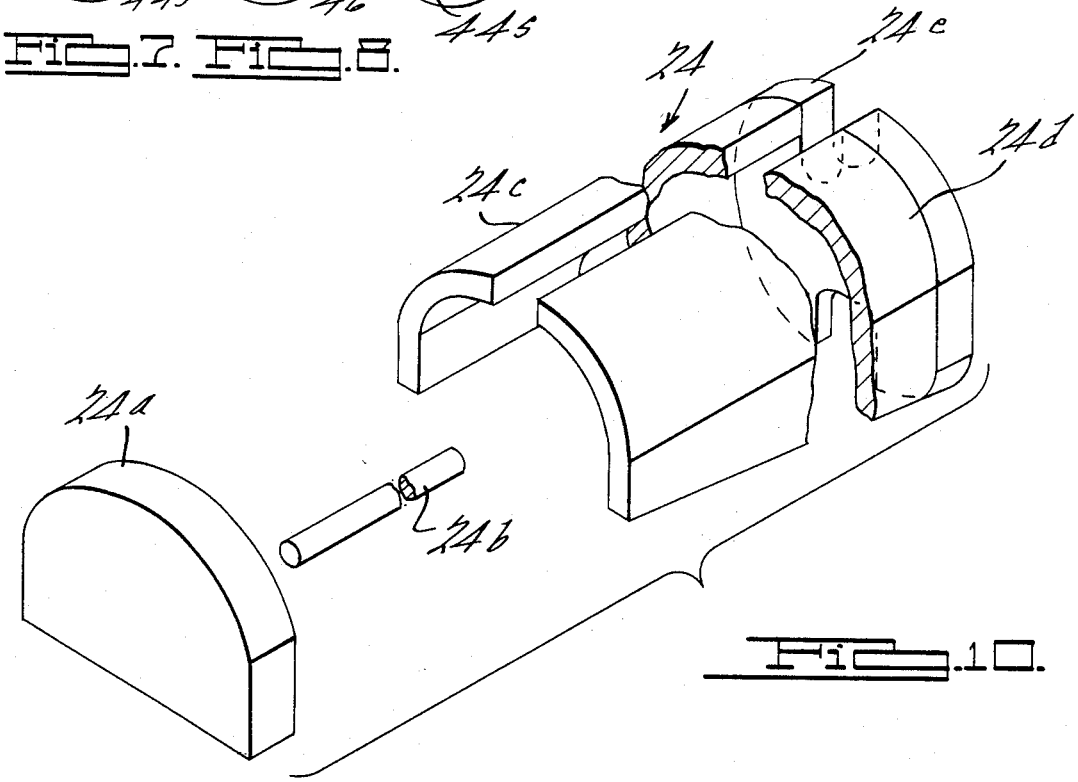
FIG. 10 is an enlarged perspective view illustrating in exploded form additional elements of FIG. 1 by themselves.

Secondary winding 12*s* is preferably formed from an insulated magnet wire and subsequently impregnated with suitable further insulation. One end 12*s*′ of secondary winding 12*s* is soldered to one end of a high voltage lead wire 50 within the left hand end coil receiving space 46 as viewed in FIG. 1. Wire 50 wraps at least a fraction of a turn around the root surface of core 36 and extends outwardly through a small hole 52 in end wall 38; the other end of wire 50 is soldered to connector 26. At this time in the assembly procedure, the space between wire 50 and hole 52 may be sealed vacuum tight for example, by a dab of suitable adhesive. (The purpose of this will be seen in connection with subsequent description of a preferred method for making coil 12.) This wire 50 may be, for example, a short piece of #26 dead soft copper while the wire forming secondary 12*s* may be, for example, #40 double insulated magnet wire. Note that hole 52 is positioned tangent to the root surface of core 36. This bobbin construction permits magnet wire to be conveniently wound in layers in the first coil receiving space 46 between end wall 38 and the immediately adjacent wall 42. The wire is preferably wound according to conventional coil winding techniques to produce a series of overlying layers built up within the coil receiving space. Winding is preferably as orderly as practical to minimize the layer to layer voltage gradient as will be explained in detail later. (It will be appreciated that the specific detail of each coil section of secondary winding 12*s* illustrated in the drawing is merely illustrative and does not necessarily reflect the specific number of turns per layer or number of layers in each section.) When these layers reach the level of the bottom of slot 42*s*, further winding ceases and the wire is led out through slot 42*s* and into the immediately adjacent separating space 48. (This transition of the wire is best seen in FIG. 9.) The wire is then directed inwardly through space 48 and arcuately along the root surface of core 36 to pass through the slot 44*s* in the immediately adjacent wall 44 and into the next coil receiving space 46. As seen in FIG. 9, the segment of the wire which makes the transition between adjacent coil sections is identified by the numeral 12*s*'''. Slot 44*s* permits the wire to be brought to the cylindrical root surface of core 36 in this second coil space 46 so that it may then be conveniently wound in layered fashion therein. The process of winding successive layered coil sections in this fashion on bobbin 20 is continued until the last space 46 between end wall 40 and the immediately adjacent wall 44 is filled. The wire, then, is soldered to one end of a wire 53 within space 46. Wire 53, which may be #26 dead soft copper, wraps at least a portion of a turn around the coil section and is brought out through a small hole 54 in end wall 40 where it is available for connection to other wires as will be seen hereinafter. Thus the secondary winding structure is characterized by a plurality of individual coil sections disposed around a common axis and spaced axially apart along this axis. The individual coil sections are separated by separating means consisting of a set of walls 42, 44 and the intervening separating space 48. The coil sections are wound in the same sense and electrically connected together in series by the sections of the wire 12*s*''' extending through the slots 42*s* and 44*s* and separating spaces 48.

An important advantage of an ignition coil embodying the principles of the present invention is that at no location along the secondary winding does the wire forming the secondary winding cross or approach itself at points between which a large voltage difference exists. By providing a large number of coil receiving spaces, each of which has layers containing a small number of turns, the invention minimizes the layer to layer voltage gradient thereby permitting the use of the aforementioned type wire without any extra insulating material other than impregnation as will be described. For example, assuming that a maximum of five volts per turn is generated in secondary winding 12*s* then the turn to turn voltage is five volts. If each coil section contains fifteen turns in each layer, then the layer to layer voltage is one hundred fifty volts. As the number of turns in each layer is decreased the layer to layer voltage gradient becomes even less. By way of example, with the aforementioned specific type secondary wire, the coil receiving spaces may be made to have an axial dimension of about one-sixteenth inch. The ignition coil of the present invention is much superior to currently available coils. Currently available ignition coils often use layers of wax paper or other sheet material as insulation between layers of the secondary winding, as the wire insulation alone cannot withstand the layer to layer voltage gradients generated therein. Furthermore, this extra insulation not only adds to the bulk and cost of the coil but can also impede heat transfer in the radial direction and increases the distributed capacitance of the secondary. In contrast, a coil embodying the concepts of the present invention requires no such insulation layers and can thereby be substantially less bulky than prior coils while at the same time being more efficient in that efficient heat transfer is promoted and distributed capacitance is minimized.

A further advantage provided by the invention resides in the way in which the separate coil sections are separated from each other. Since each coil section generates a fraction of the desired total coil output, the several sections are connected together in series aiding fashion. As a result, a section to section voltage gradient may be quite high; for example, on the order of four kilovolts maximum is typical. To insure proper protection against such section to section voltage gradient, the preferred construction provided by the walls 42, 44 and the separating spaces 48 protects against this large section to section voltage gradient. It will be observed the interconnecting wire sections 12*s*''' which extend through the separating spaces 48 to connect immediately adjacent coil sections do not pass closely to a point of different voltage without adequate insulation. Further advantages are attained by making bobbin 20 of a material having high dielectric strength but low dielectric constant such as certain high temperature resins. In this way the capacitance between adjacent coil sections is minimized yet maximum protection is afforded against large voltage gradients. Thus the entire construction of the secondary winding structure attains maximum protection yet may be constructed compactly. Further advantages exist when the coil is utilized in a system such as illustrated. In accordance with the preferred system, by mounting each individual coil directly on a spark plug, a minimum length connection from the output of the secondary winding to the spark plug terminal is attained. This minimizes radio interference and secondary distributed capacitance. When also used in conjunction with the encapsulating boot 30 as previously described, it can be seen that the present system provides important and advantageous benefit over prior conventional type systems. By providing an individual ignition coil for each spark plug, the size of the coil can be made even further compact since each ignition coil operates only once per firing of the associated spark plug; this is in contrast to multiple spark plug systems having only a single ignition coil where the coil duty cycle is increased by the number of plugs the coil must handle.

Continuing now with further details of coil 12, sleeve 22 has an inside diameter slightly greater than the outside diameter of the walls of bobbin 20. After secondary winding 12*s* has been wound on bobbin 20, sleeve 22 is assembled thereon by first inserting the right hand end of the bobbin as viewed in FIG. 1 into the left hand end of sleeve 22 as viewed in FIG. 1, and then sliding the two together. When the two are in assembled relation, an O-ring seal 56 which has been previously lodged in a groove in end wall 38 is interengaged between the bobbin and the sleeve to thereby seal that end of the assembly. Preferably, sealing lubricant, such as silicone grease, is applied to O-ring seal 56 both to facilitate assembly thereof onto bobbin 20 and also to provide better sealing with the bobbin and the sleeve when the two are assembled together. At this stage it is preferable to introduce the impregnating liquid, such as an epoxy or RTV silicone for example, into sleeve 22 to thereby encapsulate the secondary winding 12*s*. This is done in the following manner.

The partially completed assembly is positioned uprightly with the left hand end as viewed in FIG. 1 down and the right hand end as viewed in FIG. 1 up. The open upper end of core 36 is temporarily plugged by a suitable plug and the partially completed assembly is placed in a vacuum chamber. Vacuum is drawn such that the chamber is evacuated, for example, to approximately 0.2 microns. Experimental assemblies have been held at this pressure for fifteen minutes before introduction of impregnating liquid. Impregnating liquid is introduced into the vacuum chamber through a tube to fall into the open upper end of the partially completed assembly. As this end becomes filled with liquid, vacuum may be relieved to cause greater pressure to act on the impregnating liquid, forcing the same down into the space between bobbin 20 and sleeve 22 and around the secondary winding. If sufficient volume is provided at the upper end of the assembly to receive an amount of liquid sufficient to impregnate the entire assembly, then vacuum may be reduced immediately upon filling the assembly to the desired level. An advantageous method of insuring sufficient volume at the upper end of the assembly and which permits vacuum to be relieved immediately upon filling the upper end of the assembly to the desired level is provided by making the wall of sleeve 22 sufficiently long so that when it is initially assembled onto bobbin 20 there is provided a reservoir at the upper end thereof of sufficient volume to permit initial filling of the reservoir with an amount of liquid sufficient to encapsulate the entire winding. After the liquid has been drawn from this reservoir in amount sufficient to encapsulate the entire winding any excess length of the sleeve, along with any excess encapsulating material which has solidified therein, may be cut off to provide the desired finished length of sleeve 22. It is undesirable to permit the reservoir at the upper end to be drained completely of liquid before vacuum in the chamber is relieved. In experimental assembly, it has been noted that significant drops in fluid level in the reservoir have been noted as much as an hour following introduction of atmospheric pressure to the chamber. This indicates a substantial length of time for viscous liquid to flow into the small previously evacuated interstices of the winding and illustrates the desirability of utilizing an impregnating liquid of low viscosity and relatively long curing time such as those mentioned earlier. Once the liquid has solidified, the incomplete assembly may be further processed.

Sleeve 22 is further provided with a pair of end flanges 58, 60. Primary winding 12*p* is wound around sleeve 22 between flanges 58 and 60 and opposite ends of primary winding 12*p* exit via small holes 58*a*, 60*a* in the respective flanges. One end 12*p'* of the wire forming winding 12*p* is soldered to the lead wire 34 which enters boot 30; the other end 12*p''* of winding 12*p* and one end of wire 53 are soldered to lead wire 32. By way of example, winding 12*p* may be formed as a conventional single layer such as thirty turns of #24 wire.

The magnetic circuit structure 24 is next assembled with the individual elements being bonded together by suitable adhesive to provide the structure shown in FIG. 1. Preferably the elements forming the magnetic structure 24 are of soft ferrite material possessing high permability and low loss characteristics. By way of example, experimental assemblies have used Arnold Engineering material AK30, although it is contemplated that other materials may also be used. It will be observed that with the individual ferrite pieces assembled as illustrated in FIG. 1, a magnetic circuit linking primary winding 12*p* and secondary winding 12*s* is provided with an air gap 62. Air gap 62 is of such dimension to provide high resonant frequency. This means that the resulting coil has a fast voltage rise time across the spark plug gap 14*g* when the ignition coil is energized. Note that wire 50 is routed to clear the end magnetic element 24*a* while wires 53, 12*p* and 12*s* pass through a slot in the other end element 24*e*. The resulting assembly is particularly compact and may now be encapsulated by boot 30. Boot 30 can be formed by conventional techniques to provide the illustrated construction which was previously described in detail.

A system according to the present invention renders possible a longer spark plug gap 14*g* as shown in FIG. 4. Because the air/fuel mixture ratio throughout the cylinder volume is not homogeneous (even though the ratio may be correct in gross), such a longer spark plug gap increases the probability of the spark finding a mixture of combustible air/fuel ratio along its path. If the gap is too small, the probability of the spark encountering only mixtures which are too rich or too lean for combustion increases and the probability of combustion correspondingly decreases. Hence, a longer gap is definitely desirable. However, if the gap is too wide, the ignition system may not be capable of producing sufficient voltage across the spark plug to ionize it either because of inherent electrical design or because of insulation failure flashover or puncture at a voltage below the required level to cause ionization. This is true of prior conventional systems wherein spark plug gap specifications are limited by the capability of the ignition system to achieve a high voltage at the spark plug gap. Gap specifications must further allow for a period of service in which spark erosion widens the gap and rounds off sharp corners provided in a new plug. Both of these effects increase spark plug voltage requirement. Some currently available capacitor discharge ignition systems have a fifty kilovolt capability. However, most high voltage distribution systems such as those currently used in mass production multi-cylinder engine application will not tolerate such a high electrical stress without flashover or puncture. The average clean spark plug insulator not protected by a tightly fitting rubber boot will flash over the exterior insulator surface at approximately 20 kilovolts. Thus it becomes readily apparent that ignition systems with parts of average age cannot utilize a fifty kilovolt secondary level and would likely be severely damaged.

In contrast to the prior art, the present invention provides an ignition system wherein much higher secondary voltages can be generated without damage to the ignition system and without flashover or puncture. This permits a longer spark plug gap and hence increases the probability of igniting air/fuel mixtures in the cylinders. Thus this tends to reduce exhaust emission and is especially important in older vehicles. The life of system elements is also prolonged. The invention therefore improves the reliability of ignition systems and can reduce the interval required between replacement of parts thereby minimizing maintenance costs.

A further problem which is alleviated by the present invention is that of fouling of the spark plugs due to deposits of combustion products thereon over the course of service of the plugs. This fouling creates a shunt resistance across the spark plug gap and imposes an appreciable power loss on the ignition system. During the rise time of the voltage across the spark plug gap this shunt resistance creates a continuous drain on the ignition system thereby drawing away power which would otherwise be available for increasing the voltage across the spark gap. Since the peak voltage capability of the system of the present invention renders possible a faster rise of voltage across the spark plug gap, the problem of shunt resistance is greatly minimized. A secondary voltage rise time of two and one half microseconds is typical for the coil of this invention.

There is yet a substantial improvement in attaining an. even faster rise time of voltage across the spark plug gap and this has to do with minimization of secondary distributed capacitance. In conventional distributor type systems currently in use in multi-cylinder engine applications, the secondary capacitance can be on the order of 50 picofarads. Since this capacitance must be charged to the same voltage as is developed across the spark plug gap, it can create a substantial drain on ignition system performance. The loss is further increased in conventional systems because this distributed capacitance is along the shole length of the secondary circuit from the distributor to the spark plugs. By mounting an ignition coil directly on each spark plug, this capacitance is minimized and can be even further minimized by the preferred construction of ignition coil disclosed herein.

While the construction of ignition coil 12 described hereinabove is preferred, it is contemplated that, in accordance with principles of the invention, alternative means may be used for establishing separating spaces between coil section into which dielectric impregnating material is subsequently introduced. For example, temporary spacers inserted during winding and removed prior to impregnation could be used. This would leave the separating spaces which would be filled by dielectric impregnating material during the encapsulating process. Thus it would be possible to attain the preferred dielectric characteristics separating immediately adjacent. coil sections (i.e., high dielectric strength but low dielectric constant) without the use of the pair of walls and intervening separating space between immediately adjacent coil sections. Furthermore, it should be mentioned that the preferred impregnating material is composed of a flowable substance of substantially 100% solids.

FIGS. 11–18 disclose details of a second embodiment of an ignition coil 70 according to the present invention. Ignition coil 70 comprises a plastic bobbin 72 (shown by itself in FIG. 14); a secondary winding 70*s* which is wound on bobbin 72 in the fashion previously explained herein; an outer plastic sleeve 74 which fits over bobbin 72 and secondary winding 70*s;* a primary winding 70*p* wound around sleeve 74; an encapsulating material encapsulating and impregnating the secondary winding 70*s* on bobbin 72 within sleeve 74 (and which has been omitted from the drawing figures for sake of clarity but is essentially the same as that shown at 23 in FIG. 3); magnetic element 76; a brass spark plug terminal connector 78 threaded into the bore of a circular boss 108 fashioned integrally with bobbin 72; a grounding member 82 which connects the ground terminal of the primary to the engine block, either through the spark plug 14 or to the engine block directly; and an encapsulating boot 84 preferably of silicone rubber enclosing the entire assembly. As can be seen in FIG. 1, the entire ignition coil 70 is mounted directly on spark plug 14 by pushing connector 78 onto the terminal plug 14*p* of spark plug 14. At the same time the grounding member 82 engages either the spark plug 14 or the engine block directly to provide a ground connection for the primary coil 70*p* to complete the current path through the primary coil 70*p*. As will be explained in greater detail hereinafter, the use of a grounding member which is not connected until the coil is mounted on the spark plug 14 avoids the possibility of any damage being caused by high potential discharges when the ignition coil assembly 70 is not mounted on the spark plug 14.

Figure 11:
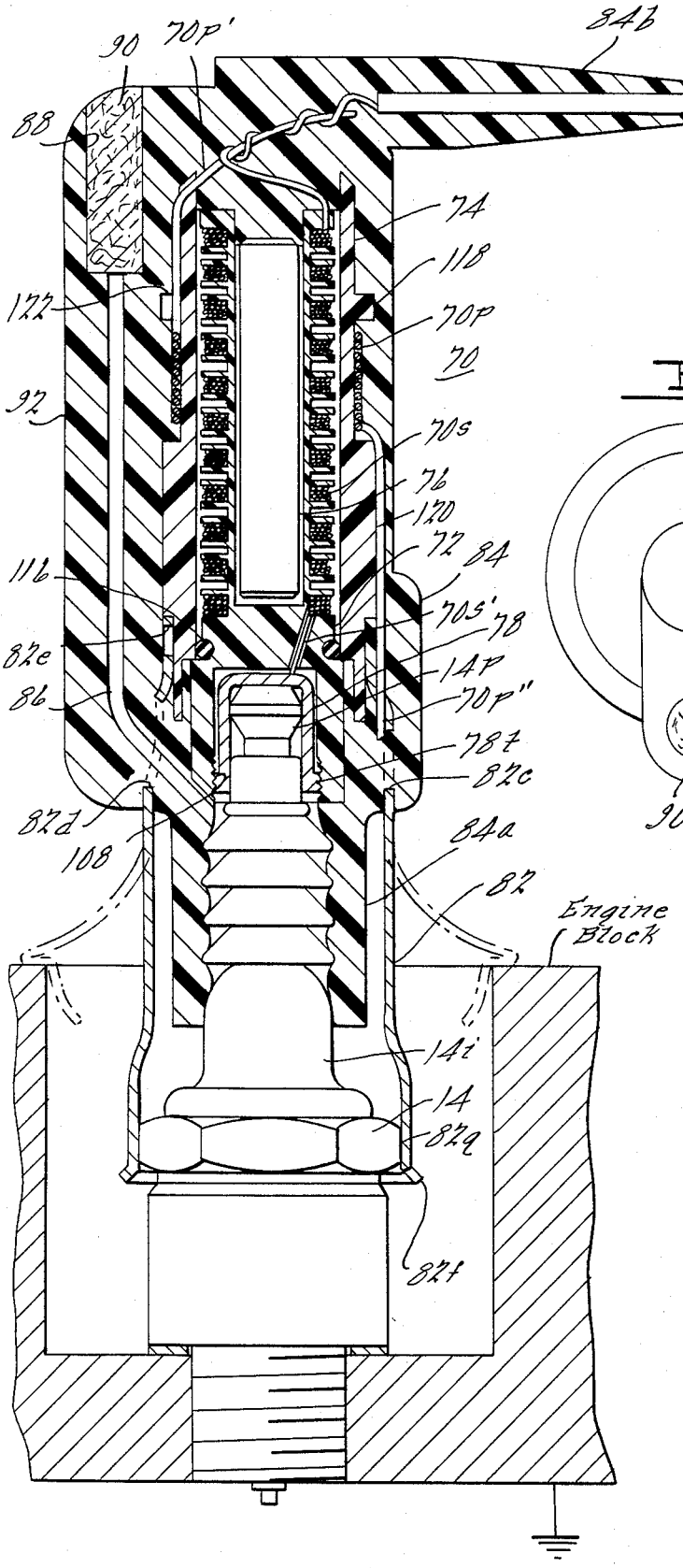
FIG. 11 is a view of a second embodiment illustrating the principles of the invention, a portion of the view being a longitudinal sectional view through the second embodiment of the ignition coil according to the present invention as mounted on a spark plug.

In accordance with this invention, the boot 84 has a vent passage 86 which communicates the otherwise sealed volume between the boot 84 and the spark plug 14 with the atmosphere. The passage 86 has an enlarged bore portion 88 at its vent opening containing filter material 90 which may be glass wool which is saturated with silicone oil. As can be seen in FIG. 11, boot 84 is provided with a sealing lip 84*a* which seals around the ceramic insulation 14*i* of plug 14 when the coil 70 is mounted on the plug 14. Lip 84*a* provides a snug force fit to seal off the connection between connector 80 and terminal plug 14*p*. Furthermore, the opposite end of boot 30 is shaped to provide a seal and strain relief 84*b* around lead wire 32 which connects the ignition coil to the hot terminal of the primary voltage distribution system. In this way, the entire coil assembly is enclosed to provide both a moisture seal and electrical insulation preventing flashover.

Figure 12:
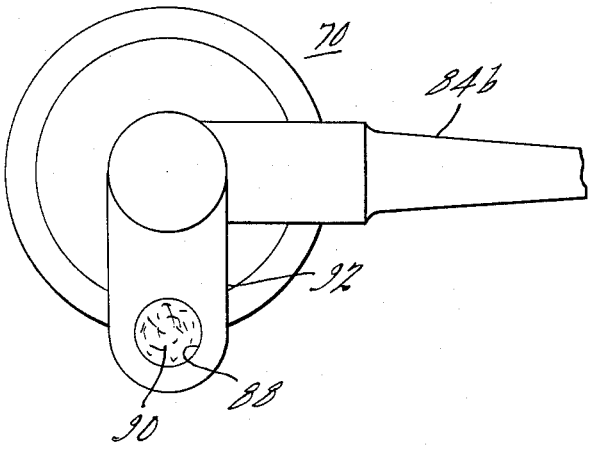
FIG. 12 is a top elevational view of the second embodiment of FIG. 11.
Figure 13:
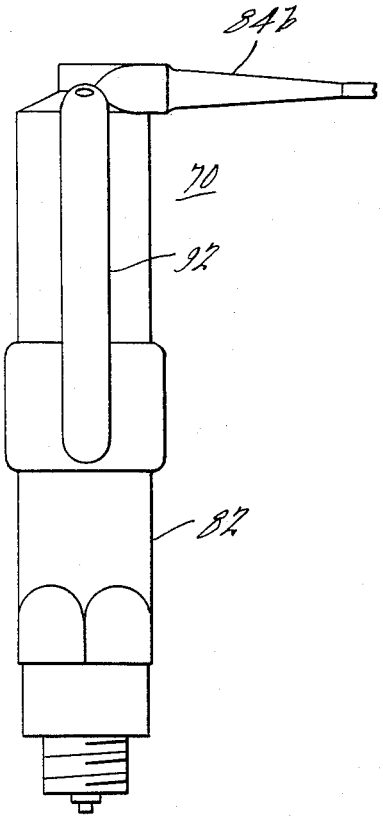
FIG. 13 is a side elevational view of the second embodiment of FIG. 11.
Figure 13:
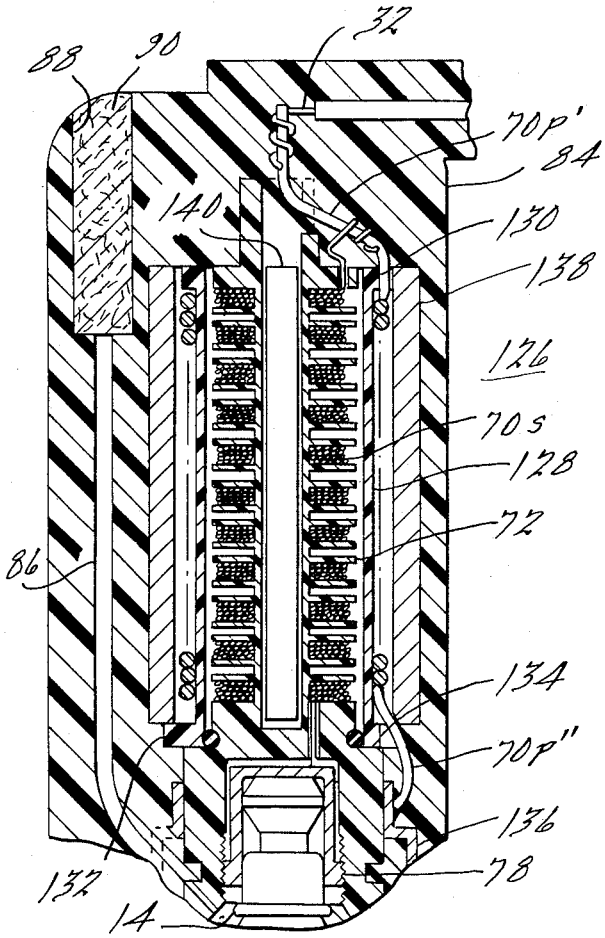

The overall configuration of the ignition coil structure 70 can be better appreciated by reference to FIGS. 12 and 13 which are elevation views of the ignition coil assembly 70. In FIGS. 12 and 13 it can be seen that the boot 84 generally conforms to the cylindrical configuration of the ignition coil portion and has a projecting portion 92 which contains the vent passage 86 and the filter 90 and which is perpendicular with respect to the strain relief 84*b* (but shown in the same plane in FIG. 11 for clarity). The grounding member 82 protrudes from the lower portion of the exterior boot surface. The grounding member can be axially aligned with the remainder of the ignition coil structure as shown to provide a compact but axially elongated structure, or the grounding member and high voltage connector 70 may be at an angle to the remainder of the ignition coil structure, as illustrated in FIG. 1, to reduce the required clearance above the spark plug 14.

Figure 15:
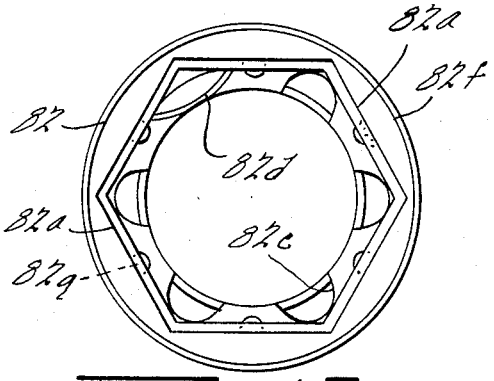
FIGS. 14–17 are views of component parts of the second embodiment of FIG. 11.
Figure 14:
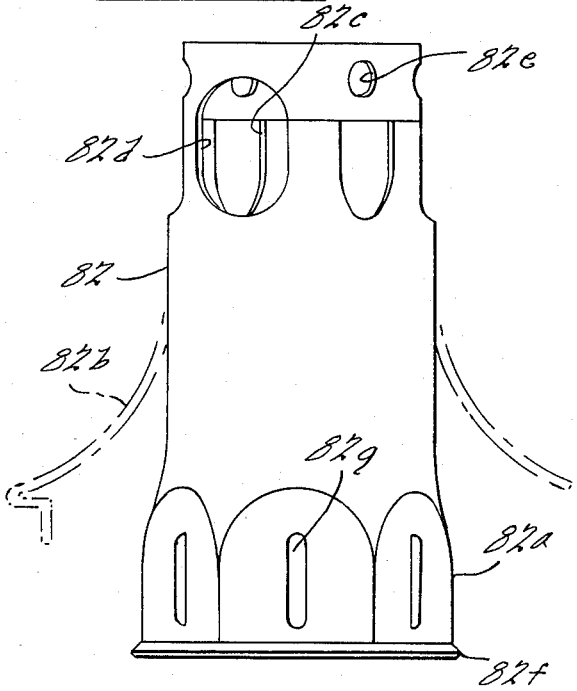

The configuration of the grounding member 82 can best be appreciated by reference to FIGS. 14 and 15 in which the grounding member 82 is shown prior to assembly. The grounding member 82 is provided with a hexagonal shaped portion 82*a* which fits over the hex portion of the spark plug 14 for electrical grounding engagement therewith. Alternatively, a ground connection can be made with the block directly using laterally-projecting resilient tongs or fingers 82*b* (shown in phantom) which may be formed by stamping from the grounding member 82. Only one of a large variety of possible configurations of the fingers 82*b* is shown by way of example. The grounding member 82 also includes a series of openings 82*c* which provide an interlacing connection between the material of the sealing boot 84 and the grounding member 82. One of these openings, shown at 82*d*, is enlarged to facilitate the placement of the vent passage 86. A series of smaller circumferentially spaced openings 82*e* are at the upper end of the grounding member 82 to strengthen an adhesive connection between the grounding member 82 and the primary coil bobbin 94. The latter are preferably bonded together by an epoxy adhesive or the like which flows through the openings 82*e* to the radially outward surface of the grounding member 82. The grounding member 82 preferably has a radially-outwardly flared bottom portion 82*f* which strengthens the structure and guides the placement of the ground member 84 over the spark plug 14.

Ordinarily, the slight eccentricities between the sealing boot 84, the terminal 78, and the grounding member 82 provide sufficient engaging force between the grounding member 84 and the spark plug 14 so that a good ground electrical connection is made. However, to further assure a good electrical connection, the flat surfaces of the hex portion 82*a* of the grounding member 84 may have indentations 82*g* to provide a slight interference fit between the hex portion of the spark plug 14 and the grounding member 82.

Figure 16:
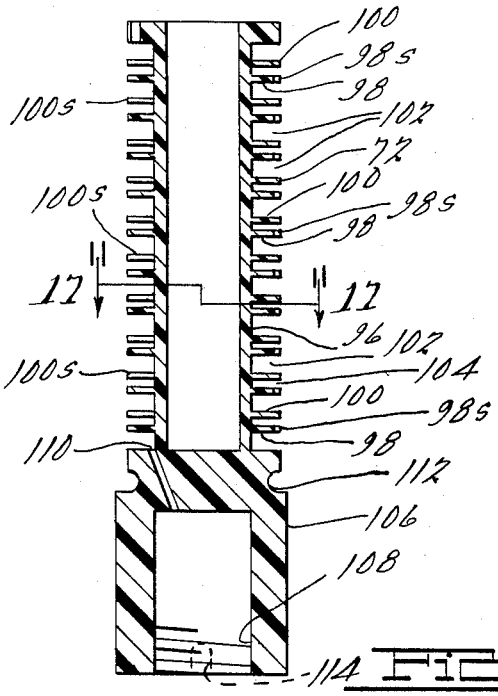
Figure 17:
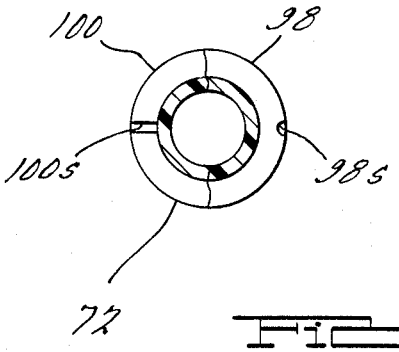

As best seen in FIGS. 16 and 17, bobbin 72 further comprises a central tubular core 96 and a plurality of annular walls, or disc-like partitions, spaced axially along core 96. Core 96 forms a cylindrical root surface between adjacent walls and of uniform diameter throughout the length of bobbin 72. Each wall 98 of the pair of walls 98 and 100 has a shallow radial slot 98*s* extending radially inwardly from the outer periphery thereof. The slots 98*s* are relatively narrow and all are axially aligned. Each wall 100 has a similarly narrow but much deeper slot 100*s* extending radially inwardly to core 96 and displaced 180° from the slots 98*s*. It will also be observed that walls 98 and 100 are arranged in a uniform pattern along bobbin 72 such that a plurality of identical annularly shaped coil receiving spaces 102 are provided on bobbin 72. The coil receiving spaces 102 are separated by narrower annular separating spaces 104. As explained with respect to the first embodiment 12, a coil section of secondary winding 70*s* is contained in each of the coil receiving spaces 102, and therefore, each pair of walls 98, 100 and the intermediate separating space 104 provide a separating structure between immediately adjacent coil sections of the secondary winding.

The bobbin 72 has an integral axially-aligned support portion 106 for the high voltage terminal 78. Support portion 106 has a threaded bore 108 for threaded engagement with a corresponding threaded portion 78*t* on the spark plug terminal connector 78. A hole 110 in the support portion 160 provides a passage between the secondary winding 70*s* and the connector 78. The support portion 106 further includes a circumferentially-extending O-ring relief 112 and a slot 114 which accommodates the vent passage 86.

Secondary winding 70*s* is preferably formed from an insulated magnet wire and subsequently impregnated with suitable further insulation as previously described. One end 70*s*′ of secondary winding 70*s* extends through the hole 110 in the bobbin 72 and is clamped upon threading the high voltage connector 78 into bore 108. At this time in the assembly procedure, the space between wire 70*s*′ and hole 110 may be sealed vacuum tight, for example by a dab of suitable adhesive, for the same purpose as described with respect to coil 12.

The notches 98*s* and 100*s*, being 180° apart, facilitate automatic winding of the secondary 70*s* by winding machines. Note that only one-half turn of the secondary winding, sufficient to traverse from one notch to the next notch, is in the spaces 104 between the winding portions and spaces 102. The deep notches 100*s* allow the winding to hook into the space 102 on its first encounter therewith to begin the winding of the respective axially-spaced portions of the secondary winding 70*s*.

Continuing now with further details of coil 70, the sleeve 74 has an inside diameter which is slightly greater than the outside diameter of the walls of bobbin 72. After a secondary winding 70*s* has been wound on bobbin 72, sleeve 74 is assembled thereon by first placing an O-ring 116 in the relief 112 and then sliding the two together. When the two are in assembled relation, the O-ring 116 is interengaged between the bobbin and the sleeve to thereby seal that end of the assembly. Preferably, sealing lubricant, such as silicone grease, is applied to O-ring 116 both to facilitate assembly thereof onto bobbin 72 and also to provide better sealing with the bobbin and the sleeve when the two are assembled together. At this stage it is preferable to introduce the impregnating liquid, such as an epoxy or RTV silicone for example, into sleeve 74 to thereby encapsulate the secondary winding 70*s* as previously explained.

Sleeve 74 is further provided with a flange 118 and an enlarged diameter portion 120. Primary winding 70*p* is wound around sleeve 74 between flange 118 and portion 120. One end 70*p*′ of primary winding 70*p* exits via a slot 122 in the flange 118 and is soldered to the lead wire 32 which enters boot 84. The other end 70*p*″ of winding 70*p* is led along the outside of the sleeve 74 and is soldered to the grounding member 82. By way of example, winding 12*p* may be formed as a conventional single layer such as ten turns of #16 wire.

As can be seen in the drawing, the ten turns of the primary winding 70*p* are approximately centrally located relative to the secondary winding 70*s* and extend for only about a quarter of the axial length of the secondary winding 70*s*. The central location and the limited axial extension of the primary winding 70*p* relative to the secondary winding 70*s*, as illustrated, has been found to provide improved ignition performance, and particularly, an improved kilovolt level of the ignition pulse.

In FIG. 18, a slightly revised version of an ignition coil structure 126 according to the present invention is illustrated. The embodiment of FIG. 18 has a revised cylindrical sleeve 128 which includes radially-outward extending flanges 130 and 132 at its axial extremities. The flange 132 is of greater outward extension than the flange 130. One portion of the flange 132 at 134 is cut away to allow passage of the primary lead 70*p*″ for appropriate connection to the grounding member 136. A cylindrical magnetic sleeve 138 is coaxially positioned radially outwardly of the primary coil sleeve 128 so as to provide a more complete magnetic path about the primary and secondary windings in cooperations with a central magnetic element 140. The remainder of the ignition coil structure 126, including the high voltage connector 78 and the coaxially disposed grounding member 82, is essentially the same as that previously described with respect to FIGS. 11–17.

The ignition coil structures 70 and 126 may be installed dry or using a quantity of silicone oil or grease which is inserted into the boot cavity prior to the mounting of the ignition coil structures 70 and 126 onto the spark plug 14. The silicone oil or grease fills the space around the spark plug terminal 14*p* and is forced into and through the ventilation passage 86. Since silicone oil and grease have a higher dielectric strength than air, the silicone oil or grease cooperates with the silicone elastomeric material of the boot 84 to provide an airless seal of high dielectric strength to minimize the possibility of flashover along the insulator 14*i* of the spark plug 14 to the ground member 82 or the engine block.

The ventilation passage 86 allows the boot 84 to remain in place on the spark plug insulator 14*i* during operation of the engine by allowing the air which is trapped between the spark plug 18 and the boot 84 to escape or egress through the ventilation passage 86. Without the ventilation passage 86, the spark plug insulator acts as a "piston" and the boot 84 acts as a "cylinder". Air is trapped between the "piston" and "cylinder" which is expanded upon subsequent heating by the engine. The pressure of the expanding air may be sufficient to force the ignition coil structure 70 or 126 off of the spark plug 14.

The glass wool and the silicone oil or grease within the passage 86 provide an electrically secure vent passage due to the length and the insulating nature of the walls of the vent 86. The silicone saturated glass wool prevents the entrance of dirt or water which otherwise would coat the walls of the ventilating passage 86 rendering them at least partially electrically conductive.

The grounding member 82 also provides a substantial advantage. It will be appreciated that the ignition coil structure 70 or 126 has a very high kilovolt capacility, for example, between 30 to 50 kilovolts. Although this very high capability may never be attained in operation because the spark plug gap will break down prior to the attainment of the maximum voltage at the secondary winding, that high voltage capability provides an exceptionally fast initial rise time and accordingly, has the attendant advantage thereof as previously explained in detail.

The advantages of a high voltage capability ignition structure are offset in prior art ignition systems by a significant disadvantage. In a prior art system, if the secondary coil is inadvertently disconnected from the spark plug, the high voltage capability of the system may be adequate to cause flashover or puncture of the insulation to cause deterioration of the insulation. As a result, subsequent breakdowns tend to occur at lesser voltages than the voltage of the initial breakdown.

In accordance with this invention, the grounding member 82 is connected to ground at the same time that the high voltage connector is connected to the spark plug high voltage terminal so that inadvertent high voltage discharges are ordinarily avoided when the secondary winding is not connected to the spark plug. This is due to the fact that the grounding member provides the ground connection for the primary winding. Therefore, there can be no primary current flow which results in the high secondary voltage when the ground is not connected. Note that the connection of the ground terminal of the primary coil and the high voltage terminal of the secondary coil are interrelated by the mechanical structure of the ignition coil structures 70 and 126.

Should the grounding member be accidentally grounded while removed from the spark plug, the atmospheric flashover path from the secondary terminal 78 around the booth to the grounding member 82 provides a limit to the secondary voltage. This flashover path may be sized by adjusting the length of the boot to effectively adjust the spacing of the high voltage terminal 78 and the grounding member 84 along the path of least electrical resistance so that the voltage required to provide atmospheric flashover along the boot is approximately equal to the normal spark plug voltage requirement. This feature also provides the additional advantage of allowing safe and convenient verification of the operability of the ignition system should the need for trouble shooting arise in the field since the observation of the atmospheric flashover path along the boot indicates that the ignition system is producing its designed voltage.

A secondary benefit of the grounding member lies in the fact that it encloses the spark plug insulator to provide improved shielding from radio interference.

Note that openings 82*c* and 82*d* are penetrated and filled by the encapsulating elastomer permitting the simultaneous moulding of portions 84*b*, 92, and the enclosing portions into a single piece with portion 84*a*. The interlaced leg portions 82*f* of grounding member 82 provide strength and mechanical stability to the mounting of the complete assembly.

In light of the foregoing detailed description, it can be seen that the present invention provides important improvements in ignition systems for internal combustion engines. While the teachings of the present disclosure are well calculated to teach one skilled in the art the preferred embodiment and the method for making the preferred embodiment of the invention, it will be appreciated that the invention is susceptible to modification, variation and change without departing from the proper scope or meaning of the subjoined claims.

What is claimed is:

1. For an ignition system of an engine including a spark plug having a spark plug terminal, a grounded portion and a dielectric portion separating said grounded portion and said spark plug terminal, said spark plug being adapted to ignite an air/fuel mixture in a chamber of the engine when energized by a secondary voltage applied to said spark plug terminal, an ignition coil structure for removable mounting directly on said spark plug comprising:

a primary winding for receiving a primary voltage at an input conductor thereof and a secondary winding for providing said secondary voltage;

secondary terminal means connected to said secondary winding for receiving said secondary voltage and being removably connectable to said spark plug terminal for providing said secondary voltage to said spark plug terminal; and enclosure means formed of a dielectric material and surrounding said primary winding, said secondary winding and said input conductor of said primary winding to dielectrically seal the entirety of said primary winding, said secondary winding, and said input conductor for said primary winding, said enclosure means also partly surrounding said secondary terminal means and having a sealing portion for removable sealing engagement with said dielectric portion of said spark plug so that said removable sealing engagement at said dielectric portion of said spark plug dielectrically encloses said secondary terminal means whereby no direct path to a grounded structure exists between said removable sealing engagement and said secondary terminal means, said enclosure means being configured so that a space is created intermediate said dielectric portion of said spark plug and said sealing portion of said enclosure means at least upon initial mounting of said ignition coil structure on said spark plug, said enclosure means including a passage means having an entrance communicating with said space between said dielectric portion of said spark plug and said sealing portion of said enclosure means for allowing egress of matter in said space to facilitate mounting of said ignition coil structure on said spark plug and to prevent said ignition coil structure from being lifted off said spark plug upon the heat expansion of said matter in said space, said passage means extending along said enclosure means in a manner so that said passage means length is substantially greater than the thickness of said enclosure means in the vicinity of said entrance and so that said passage means length is sufficiently long to provide an electrically secure path therealong relative to said secondary voltage to prevent flashover along said passage from said secondary terminal means to a grounded structure.

2. An ignition coil structure according to claim 1 wherein said sealing portion is constructed of an elastomeric material.

3. An ignition coil structure according to claim 2 wherein said elastomeric material is silicone rubber.

4. An ignition coil structure according to claim 2 wherein said passage communicates said space between said dielectric portion of said spark plug and said enclosure means with the atmosphere.

5. An ignition coil structure according to claim 4 wherein said passage includes a filter means for filtering contaminants from the atmosphere.

6. An ignition coil structure according to claim 5 wherein said passage has an opening communicating with the atmosphere and wherein said filter means is located proximate said opening.

7. An ignition coil structure according to claim 1 wherein a hydrophobic substance is applied to said filter means.

8. An ignition coil structure according to claim 7 wherein said hydrophobic substance is silicone oil.

9. An ignition coil structure according to claim 7 wherein said hydrophobic substance is silicone grease.

10. An ignition coil structure according to claim 1 wherein said matter is air.

11. An ignition coil structure according to claim 1 wherein said matter is a silicone substance.

12. For an ignition system of an engine including a spark plug having a spark plug terminal, a grounded portion and a dielectric portion separating said grounded portion and said spark plug terminal, said spark plug being adapted to ignite an air/fuel mixture in a chamber of the engine when energized by a secondary voltage applied to said spark plug terminal, a structure for removable connection of said secondary voltage to said spark plug comprising:

secondary terminal means for receiving said secondary voltage and being removably connectable to said spark plug terminal for providing said secondary voltage to said spark plug terminal; and enclosure means formed of a dielectric material partly surrounding said secondary terminal means and having a sealing portion for removable sealing engagement with said dielectric portion of said spark plug so that said removable sealing engagement at said dielectric portion of said spark plug dielectrically encloses said secondary terminal means whereby no direct path to a grounded structure exists between said removable sealing engagement and said secondary terminal means, said enclosure means being configured so that a space is created intermediate said dielectric portion of said spark plug and said sealing portion of said enclosure means at least upon initial mounting of said structure on said spark plug, said enclosure means including a passage means having an entrance communicating with said space between said dielectric portion of said spark plug and said sealing portion of said enclosure means for allowing egress of matter in said space to facilitate mounting of said structure on said spark plug and to prevent said structure from being lifted off said spark plug upon the heat expansion of said matter in said space, said passage means extending along said enclosure means in a manner so that said passage means length is substantially greater than the thickness of said enclosure means in the vicinity of said entrance and so that said passage means length is sufficiently long to provide an electrically secure path therealong relative to said secondary voltage to prevent flashover along said passage from said secondary terminal means to a grounded structure.

13. The structure as claimed in claim 12 wherein said sealing portion is constructed of an elastomeric material.

14. The structure as claimed in claim 13 wherein said elastomeric material is silicone rubber.

15. The structure as claimed in claim 12 wherein said passage communicates said space between said dielectric portion of said spark plug and said enclosure means with the atmosphere.

16. The structure as claimed in claim 15 wherein said passage includes a filter means for filtering contaminants from the atmosphere.

17. The structure as claimed in claim 12 wherein said passage has an opening communicating with the atmosphere and wherein said filter means is located proximate said opening.

18. The structure as claimed in claim 12 wherein a hydrophobic substance is applied to said filter means.

19. The structure as claimed in claim 18 wherein said hydrophobic substance is silicone oil.

20. The structure as claimed in claim 18 wherein said hydrophobic substance is silicone grease.

21. The structure as claimed in claim 12 wherein said matter is air.

22. The structure as claimed in claim 12 wherein said matter is a silicone substance.

23. A structure according to claim 1 wherein said passage means is longer than the distance between said spark plug terminal of said spark plug and said grounded portion of said spark plug.

24. A structure according to claim 12 wherein said passage means is longer than the distance between said spark plug terminal of said spark plug and said grounded portion of said spark plug.

25. For an ignition system of an engine including a spark plug having a spark plug terminal, said spark plug being adapted to ignite an air/fuel mixture in a chamber of the engine in response to a secondary voltage applied to said spark plug terminal, an ignition coil structure for removable mounting directly on said spark plug comprising:

a primary winding having an input conductor for receiving a primary voltage, and a secondary winding for providing a secondary voltage of predetermined magnitude which is greater than a flashover voltage, at least one of said windings including a ground conductor for connection to ground potential;

secondary terminal means connected to said secondary winding for receiving said secondary voltage and being removably connectable to said spark plug terminal for providing said secondary voltage to said spark plug terminal;

a grounding member configured for engaging said engine upon the mounting of said ignition coil structure on said spark plug for providing a direct ground connection of said ground conductor to said engine and for disengaging said grounding member from said engine upon the removal of said ignition coil structure from said spark plug to interrupt said ground connection of said ground conductor, said grounding member being further configured for at least partially supporting said ignition coil; and enclosure means formed of a dielectric material and surrounding said primary winding, said secondary winding and said input conductor of said primary winding to dielectrically seal the entirety of said primary winding, said secondary winding, and said input conductor for said primary winding, said enclosure means also partly surrounding said secondary terminal means and having a sealing portion for removable sealing engagement with a dielectric portion of said spark plug so that said removable sealing engagement at said dielectric portion of said spark plug dielectrically encloses said secondary terminal means whereby no direct path to a grounded structure exists between said removable sealing engagement and said secondary terminal means, said secondary voltage predetermined magnitude being sufficient such that, absent said sealing engagement of said sealing portion of said enclosure means with said dielectric portion of said spark plug, flashover would occur to a grounded structure located proximate said sealing engagement, said enclosure means and said grounding member being cooperatively connected to provide a unitary structure comprising said primary and secondary winding, said secondary terminal, said grounding member and said enclosure means;

said grounding member having openings therein and said enclosure means extending through said openings and along said member of either side of said openings so that said grounding member is interlaced with said enclosure means.

26. An ignition coil structure according to claim 25 wherein said grounding member includes an electrically-conductive member configured for surrounding at least a portion of said spark plug.

27. An ignition coil structure according to claim 25 wherein said secondary terminal means includes an electrically-conductive connector, and said grounding member includes an electrically-conductive member configured for at least partially surrounding said spark plug.

28. An ignition coil system according to claim 27 wherein said electrically-conductive connector and said electrically-conductive member are coaxially disposed.

29. An ignition coil structure according to claim 25 wherein said primary winding and said secondary winding are coaxially disposed on a predetermined axis and said mounting means is adapted to mount said ignition coil structure on said spark plug with said predetermined axis being aligned with the axis of said spark plug.

30. For an ignition system of an engine including a spark plug having a spark plug terminal, a grounded portion and a dielectric portion separating said grounded portion and said spark plug terminal, said spark plug being adapted to ignite an air/fuel mixture in a chamber of the engine when energized by a secondary voltage applied to said spark plug terminal, an ignition coil structure for removable mounting directly on said spark plug comprising:

a primary winding having an input conductor for receiving a primary voltage and a ground conductor for connection to ground potential and a secondary winding for providing said secondary voltage;

secondary terminal means connected to said secondary winding for receiving said secondary voltage and being removably connectable to said spark plug terminal for providing said secondary voltage to said spark plug terminal;

a grounding member configured for connecting said ground conductor of said primary winding to the electrical ground of said engine upon the mounting of said ignition coil structure on said spark plug and for disconnecting said ground conductor from the electrical ground of said engine upon removal of said ignition coil structure from said spark plug, said ground member generally surrounding said secondary terminal and having an opening therethrough; and enclosure means formed of a dielectric material and surrounding said primary winding, said secondary winding and said input conductor of said primary winding to dielectrically seal the entirety of said primary winding, said secondary winding, and said input conductor for said primary winding, said enclosure means having an exterior portion which is exterior of said grounding member, a joining portion extending through said opening in said ground member and a sealing portion partly surrounding said secondary terminal means, said exterior portion being joined to said sealing portion solely by said joining portion, said sealing portion being configured for removable sealing engagement with said dielectric portion of said spark plug so that said removable sealing engagement at said dielectric portion of said spark plug dielectrically encloses said secondary terminal means whereby no direct path to a grounded structure exists between said removable sealing engagement and said secondary terminal means.

31. The structure as claimed in claim 30 wherein said grounding member has a plurality of said openings therein and said joining portion extends through each of said openings.

32. The structure as claimed in claim 31 wherein said sealing portion is constructed of an elastomeric material.

33. The structure as claimed in claim 32 wherein said elastomeric material is silicone rubber.

* * * * *